US009412507B2

(12) United States Patent
Blanding et al.

(10) Patent No.: US 9,412,507 B2
(45) Date of Patent: Aug. 9, 2016

(54) POSITIONING SYSTEM FOR AN ELECTROMECHANICAL ACTUATOR

(71) Applicant: The Boeing Company, Chicago, IL (US)

(72) Inventors: David E. Blanding, Hawthorne, CA (US); Suzanna Wijaya, Fullerton, CA (US); Niharika Singh, Fulshear, TX (US)

(73) Assignee: The Boeing Company, Chicago, IL (US)

( * ) Notice: Subject to any disclaimer, the term of this patent is extended or adjusted under 35 U.S.C. 154(b) by 107 days.

(21) Appl. No.: 14/242,826

(22) Filed: Apr. 1, 2014

(65) Prior Publication Data

US 2015/0279539 A1 Oct. 1, 2015

(51) Int. Cl.

| | |
|---|---|
| ***H01F 7/08*** | (2006.01) |
| ***H01F 7/16*** | (2006.01) |
| ***H01F 7/17*** | (2006.01) |
| ***H01F 7/06*** | (2006.01) |
| ***H01F 7/122*** | (2006.01) |
| ***H01F 7/123*** | (2006.01) |

(52) U.S. Cl.

CPC ..... *H01F 7/16* (2013.01); *H01F 7/066* (2013.01); *H01F 7/122* (2013.01); *H01F 7/123* (2013.01); *H01F 7/1615* (2013.01); *H01F 7/17* (2013.01); *H01F 7/088* (2013.01)

(58) Field of Classification Search

CPC ..... H01F 7/066; H01F 7/0289

USPC ..... 335/222, 228, 229

See application file for complete search history.

(56) References Cited

U.S. PATENT DOCUMENTS

| | | | | | |
|---|---|---|---|---|---|
| 618,702 | A * | 1/1899 | Mason | H02K 33/18 | 246/232 |
| 2,763,793 | A * | 9/1956 | Krasney | H02K 7/065 | 310/20 |
| 3,435,391 | A * | 3/1969 | Straub | H02K 7/065 | 310/23 |
| 3,671,829 | A * | 6/1972 | Mathews | H02K 33/18 | 310/27 |
| 3,753,384 | A * | 8/1973 | Anfindsen | B23B 29/12 | 310/14 |

(Continued)

FOREIGN PATENT DOCUMENTS

| | | | |
|---|---|---|---|
| FR | 2913142 | A1 | 8/2008 |
| JP | S6474707 | A | 3/1989 |

OTHER PUBLICATIONS

"International Application Serial No. PCT/US2015/011634, Search Report and Written Opinion mailed Jun. 8, 2015", 12 pgs.

(Continued)

*Primary Examiner* — Alexander Talpalatski

(74) *Attorney, Agent, or Firm* — Kwan & Olynick LLP

(57) ABSTRACT

Provided is a shaft positioning system for an electromechanical actuator. According to various examples, the positioning system includes a shaft coupled to an electromechanical actuator. The shaft moves along a linear axis and the electromechanical actuator is free to translate during normal operation. An electromagnetic coil positioned around at least a portion of the shaft. The electromagnetic coil produces a magnetic field when electrical current is applied. A metal housing surrounds at least a portion of the electromagnetic coil. The shaft is placed in a predetermined position when the metal housing is in contact with a first magnet and translational motion of the electromechanical actuator is restricted when the shaft is placed in the predetermined position.

21 Claims, 9 Drawing Sheets

(56) References Cited

U.S. PATENT DOCUMENTS 3,781,140 A * 12/1973 Gladden ..... H02K 33/18 310/27
3,965,377 A * 6/1976 Carbonneau ..... F02M 23/10 310/14
3,991,585 A * 11/1976 Mulder ..... F02G 1/0435 62/6
4,633,209 A * 12/1986 Belbel ..... H01F 7/1638 335/251
5,012,144 A 4/1991 Huitema et al.
5,065,126 A * 11/1991 Suzuki ..... H01F 7/066 335/222
5,345,206 A * 9/1994 Morcos ..... H02K 41/0356 310/13
5,745,019 A * 4/1998 Renger ..... A61N 1/3925 335/222
6,079,960 A * 6/2000 Funatsu ..... F04B 35/045 417/313
6,494,662 B1 * 12/2002 De Montalembert ..... A61F 2/68 192/223.3
6,540,485 B2 * 4/2003 Nara ..... F04B 35/04 310/12.19
6,741,151 B1 * 5/2004 Livshitz ..... H01F 7/066 335/222
6,975,195 B2 * 12/2005 Rausch ..... H01F 7/066 335/220
7,190,096 B2 3/2007 Blanding et al.
7,705,702 B2 * 4/2010 Craig ..... H01F 7/066 335/207
2002/0050897 A1 * 5/2002 Montuschi ..... F02M 51/0696 335/220
2008/0304154 A1 * 12/2008 Lee ..... G02B 7/08 359/557
2012/0000994 A1 * 1/2012 Graner ..... F02M 51/0682 239/533.3
2012/0112860 A1 5/2012 Gruden
2013/0200966 A1 8/2013 Michaelsen et al.

OTHER PUBLICATIONS

Coffman, Jeffrey C.., et al., "Pneumatic Positioning System", U.S. Appl. No. 14/242,817, filed Apr. 1, 2014.

* cited by examiner

POSITIONING SYSTEM FOR AN ELECTROMECHANICAL ACTUATOR

BACKGROUND

Actuators are used in various mechanical devices to control the features and moving parts of these devices. Specifically, an actuator is a motor that is used to control a system, mechanism, device, structure, or the like. Actuators can be powered by various energy sources and can convert a chosen energy source into motion.

For instance, actuators are used in computer disk drives to control the location of the read/write head by which data is stored on and read from the disk. In addition, actuators are used in robots, i.e., in automated factories to assemble products. Actuators also operate brakes on vehicles, open and close doors, raise and lower railroad gates, and perform numerous other tasks of everyday life. Accordingly, actuators have wide ranging uses.

In the field of aeronautics, actuators are used to control a myriad of control surfaces that allow aircraft to fly. For instance, each of the flaps, spoilers, and ailerons located in each wing, require an actuator. In addition, actuators in the tail control the rudder and elevators of an aircraft. Furthermore, actuators in the fuselage open and close the doors that cover the landing gear bays. Actuators are also used to raise and lower the landing gear of an aircraft. Moreover, actuators on each engine control thrust reversers by which a plane is decelerated.

Commonly used actuators fall into two general categories: hydraulic and electric, with the difference between the two categories being the motive force by which movement or control is accomplished. Hydraulic actuators require a pressurized, incompressible working fluid, usually oil. Electric actuators use an electric motor, the shaft rotation of which is used to generate a linear displacement using some sort of transmission.

Although hydraulic actuators have been widely used in airplanes, a problem with hydraulic actuators is the plumbing required to distribute and control the pressurized working fluid. In an airplane, a pump that generates high-pressure working fluid and the plumbing required to route the working fluid add weight and increase design complexity because the hydraulic lines must be carefully routed. In addition, possible failure modes in hydraulic systems include pressure failures, leaks, and electrical failures to servo valves that are used to position control surfaces. However, one inherent feature of hydraulic systems is that hydraulic flight control systems can use damping forces to maintain stability after a failure has been detected.

Electric actuators overcome many of the disadvantages of hydraulic systems. In particular, electric actuators, which are powered and controlled by electric energy, require only wires to operate and control. However, electric actuators can also fail during airplane operation. For instance, windings of electrical motors are susceptible to damage from heat and water. In addition, bearings on motor shafts wear out. The transmission between the motor and the load, which is inherently more complex than the piston and cylinder used in a hydraulic actuator, is also susceptible to failure. In both electrical and hydraulic systems a mechanical failure of an actuator, e.g. gear or bearing failure, etc., can result in a loss of mechanical function of the actuator. In addition, electrical systems can fail. One type of electrical failure occurs when there is a failure of the command loop that sends communications to an actuator. Another type of electrical failure occurs when a power loop within the actuator fails, such as a high power loop to a motor.

As electronic actuator systems are increasingly used in aircraft designs, new approaches are needed to address possible failure modes of these systems. Fault-tolerance, i.e., the ability to sustain one or more component failures or faults yet keep working, is needed in these systems. Because electric flight control systems do not have hydraulic fluid available for damping, there is a need for alternative fail safe systems that can be used in the event of a failure.

SUMMARY

Provided are various examples of a shaft positioning system that can be used as a secondary fail-safe system for an electromechanical actuator when a primary system fails. According to various examples, the positioning system includes a shaft coupled to an electromechanical actuator. The shaft moves along a linear axis and the electromechanical actuator is free to translate during normal operation. An electromagnetic coil is positioned around at least a portion of the shaft. The electromagnetic coil produces a magnetic field when electrical current is applied. A metal housing surrounds at least a portion of the electromagnetic coil. The shaft is placed in a predetermined position when the metal housing is in contact with a first magnet and translational motion of the electromechanical actuator is restricted when the shaft is placed in the predetermined position.

In one aspect, which may include at least a portion of the subject matter of any of the preceding and/or following examples and aspects, the shaft positioning system also includes a spring coupled to the shaft. The spring holds the shaft in a retracted position when the electrical current is applied to the electromagnetic coil. The electromagnetic coil repels the first magnet when the electrical current is applied.

In one aspect, which may include at least a portion of the subject matter of any of the preceding and/or following examples and aspects, the metal housing attracts to the first magnet when no electrical current is applied to the electromagnetic coil.

In one aspect, which may include at least a portion of the subject matter of any of the preceding and/or following examples and aspects, the shaft positioning system also includes a second magnet. The second magnet has a weaker magnetic field than the first magnet.

In one aspect, which may include at least a portion of the subject matter of any of the preceding and/or following examples and aspects, the metal housing contacts the second magnet when the electrical current is applied to the electromagnetic coil.

In one aspect, which may include at least a portion of the subject matter of any of the preceding and/or following examples and aspects, the metal housing contacts the first magnet when no electrical current is applied to the electromagnetic coil.

In one aspect, which may include at least a portion of the subject matter of any of the preceding and/or following examples and aspects, the electromechanical actuator is a linear actuator. The shaft engages with a flange of the linear actuator when the shaft is moved into the predetermined position.

In one aspect, which may include at least a portion of the subject matter of any of the preceding and/or following examples and aspects, the shaft is part of a rotary actuator.

In one aspect, which may include at least a portion of the subject matter of any of the preceding and/or following examples and aspects, the shaft positioning system also includes a centering cam and a locking cam. The centering cam and locking cam engage when the shaft is in the predetermined position. The centering cam and locking cam are disengaged when the shaft is in a retracted position.

In one aspect, which may include at least a portion of the subject matter of any of the preceding and/or following examples and aspects, the shaft moves to the predetermined position during a power failure.

According to various examples, a mechanism includes a flight control computer system, a translating shaft having an axis, an electromechanical actuator that moves the translating shaft along the axis, and a shaft positioning system. The electromechanical actuator is communicatively coupled to the flight control computer. The shaft positioning system includes a shaft coupled to the electromechanical actuator. The shaft moves along a linear axis and the electromechanical actuator is free to translate during normal operation. The shaft positioning system also includes an electromagnetic coil positioned around at least a portion of the shaft. The electromagnetic coil produces a magnetic field when electrical current is applied. A metal housing surrounds the electromagnetic coil. In addition, the shaft positioning system includes a first magnet. The shaft is placed in a predetermined position when the metal housing is in contact with the first magnet and translational motion of the translating shaft and the electromechanical actuator is restricted when the shaft is placed in the predetermined position.

In one aspect, which may include at least a portion of the subject matter of any of the preceding and/or following examples and aspects, the mechanism also includes a spring coupled to the shaft. The spring holds the shaft in a retracted position when the electrical current is applied to the electromagnetic coil. The electromagnetic coil repels the first magnet when the electrical current is applied.

In one aspect, which may include at least a portion of the subject matter of any of the preceding and/or following examples and aspects, the metal housing attracts to the first magnet when no electrical current is applied to the electromagnetic coil.

In one aspect, which may include at least a portion of the subject matter of any of the preceding and/or following examples and aspects, the apparatus also includes a second magnet. The second magnet has a weaker magnetic field than the first magnet.

In one aspect, which may include at least a portion of the subject matter of any of the preceding and/or following examples and aspects, the metal housing contacts the second magnet when the electrical current is applied to the electromagnetic coil.

In one aspect, which may include at least a portion of the subject matter of any of the preceding and/or following examples and aspects, the metal housing contacts the first magnet when no electrical current is applied to the electromagnetic coil.

In one aspect, which may include at least a portion of the subject matter of any of the preceding and/or following examples and aspects, the electromechanical actuator is a linear actuator. The shaft engages with a flange of the linear actuator when the shaft is moved into the predetermined position.

In one aspect, which may include at least a portion of the subject matter of any of the preceding and/or following examples and aspects, the shaft is part of a rotary actuator.

In one aspect, which may include at least a portion of the subject matter of any of the preceding and/or following examples and aspects, the apparatus includes a centering cam and a locking cam. The centering cam and locking cam engage when the shaft is in the predetermined position. The centering cam and locking cam are disengaged when the shaft is in a retracted position.

In one aspect, which may include at least a portion of the subject matter of any of the preceding and/or following examples and aspects, the shaft moves to the predetermined position during a power failure.

These and other embodiments are described further below with reference to the figures.

DETAILED DESCRIPTION OF EXAMPLE EMBODIMENTS

Figure 1A:
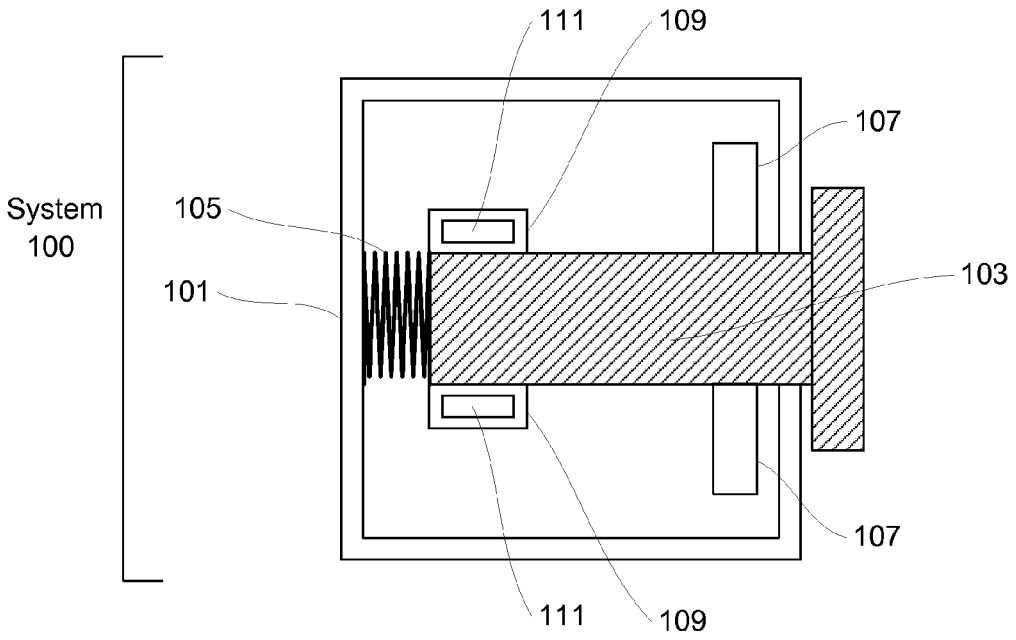
FIGS. 1A-1B are diagrammatic representations of a positioning system using electromagnetic and spring forces for an electromechanical linear actuator, in accordance with some embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

INTRODUCTION

As electromechanical actuator systems are increasingly used in aircraft designs, new approaches are needed to address possible failure modes of these systems. Fault-tolerance, i.e., the ability to sustain one or more component failures or faults yet keep working, is needed in these systems. Because electric flight control systems do not have hydraulic fluid available for damping, there is a need for alternative fail safe systems that can be used in the event of a failure.

A primary flight control system requires the control surfaces to be stable even after failures occur in the actuation systems. In the case of a primary flight control system failure, the control surface must continue to be stable by either maintaining sufficient damping or locking in place. If the control surface is not damped or locked, the surface can become unstable, resulting in failure of the wing to function appropriately.

Various mechanisms are presented that are designed to stabilize primary flight control surfaces in the event of a failure to the primary flight control actuation system. In particular, various examples provide a secondary fail-safe system that positions and holds the flight control surface should the primary drive system fail, thereby providing stability of the flight control surface. Specifically, the positioning system includes an electromagnetic coil used to position and secure an electromechanical actuator, according to various examples. In case of a power failure, the shutdown of electric power, or a mechanical failure, the positioning system returns the electromechanical actuator to a predetermined position, such as a known or neutral position. In addition, according to various embodiments, the positioning system can automatically reset itself into an operating position after being placed into a predetermined position.

Although various examples described relate to the use of a positioning system for electromechanical actuators with aircraft designs, the positioning system can be used with various mechanical devices and vehicles. For instance, the positioning system can be used in commercial airplanes, military airplanes, rotorcraft, launch vehicles, spacecraft/satellites, and the like. Furthermore, the positioning system can be used in vehicle guidance control systems. In addition, the positioning system can be used in various devices such as, but not limited to, robots, land vehicles, rail vehicles, gates, doors, and the like.

System Examples

Figure 1B:
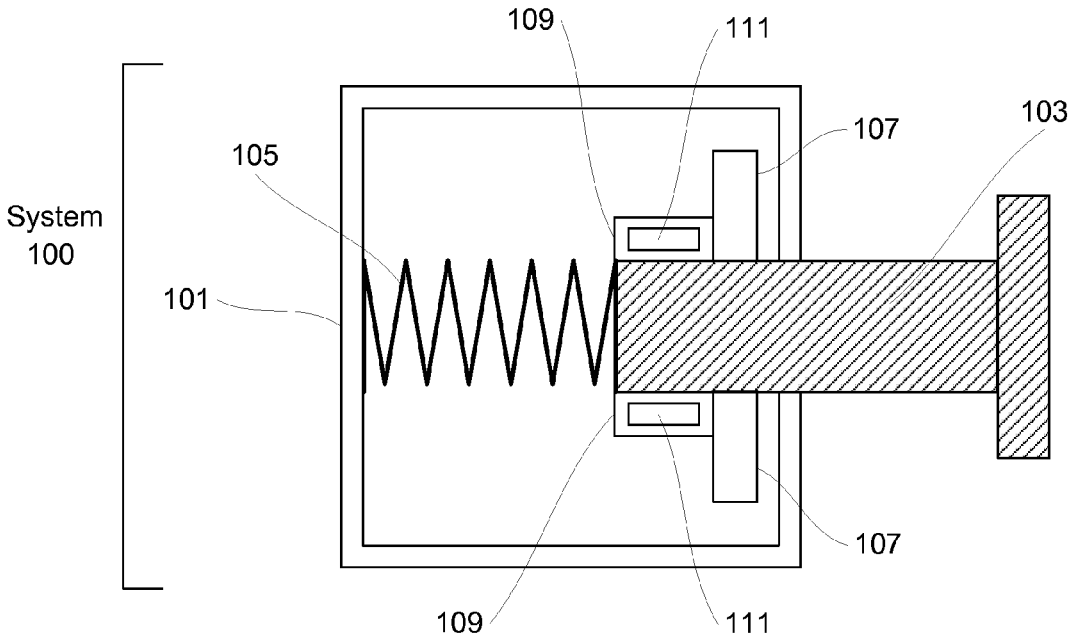

Various mechanisms are presented that provide an electromechanical shaft positioning system that can be used as a secondary fail-safe system when a primary system fails. With reference to FIGS. 1A-1B, shown are diagrammatic representations of a shaft positioning system for an electromechanical linear actuator, in accordance with some embodiments. In particular, the positioning system in FIG. 1A is shown in a refracted position and the positioning system in FIG. 1B is shown in a protracted position. The shaft positioning system 100 combines the use of electromagnetic and mechanical spring forces to operate a shaft 103 that can be used to move an electromechanical actuator (not shown) to a predetermined position, such as a neutral or centered position. Application of the shaft positioning system is described in more detail with regard to FIGS. 4A-4B and 8.

In the example shown in FIG. 1A, positioning system 100 includes a housing 101, shaft 103, spring 105, magnet 107, metal housing 109, and electromagnetic coil 111. Spring 105 can be any type of mechanical spring, such as a set of Belleville washers, bellows springs, etc. When an electrical current is supplied to electromagnetic coil 111, the electromagnetic field produced causes the electromagnetic coil 111 to repel magnet 107. As electromagnetic coil 111 repels magnet 107, shaft 103 retracts and compresses mechanical spring 105. In this configuration, spring 105 is counterbalanced by the operation of electromagnetic coil 111. As shown, the shaft remains in a retracted position as long as an electrical current is supplied to electromagnetic coil 111.

Upon a normal power shutdown, power failure, or mechanical failure, the spring 105 expands and pushes the shaft 103 towards magnet 107, as shown in FIG. 1B. The metal housing 109 is attracted to magnet 107 and attaches to magnet 107, thereby moving and stabilizing shaft 103 into a predetermined position.

In the present embodiment, positioning system 100 combines the use of electromagnetic and mechanical spring forces to operate shaft 103 to adjust an electromechanical actuator to a predetermined position. For instance, shaft 103 can be used in case of a power failure to return the electromechanical actuator of a control surface or rotor blade to a safe position, or to return a control surface or rotor blade to a known position with accuracy during flight. In addition, positioning system 100 can drive an electromechanical actuator to a predetermined position and magnetically lock the electromechanical actuator and shaft 103 into a particular position. As described in more detail with regard to FIGS. 4A-4B, the electromechanical actuator is stabilized when moved and locked into the predetermined position, such that movement of the electromechanical actuator is reduced and resisted.

In the present embodiment, positioning system 100 can be reset to a retracted position once a protracted position is no longer needed. In particular, an electrical current can be provided to electromagnetic coil 111 such that it repels magnet 107. Attraction between metal housing 109 can be broken and the electromagnetic coil 111 can again repel magnet 107, such as to cause shaft 103 to compress spring 105. In this manner, the position of shaft 103 can be controlled and reset automatically depending on the amount and direction of the electrical current supplied to the electromagnetic coil 111.

Figure 2A:
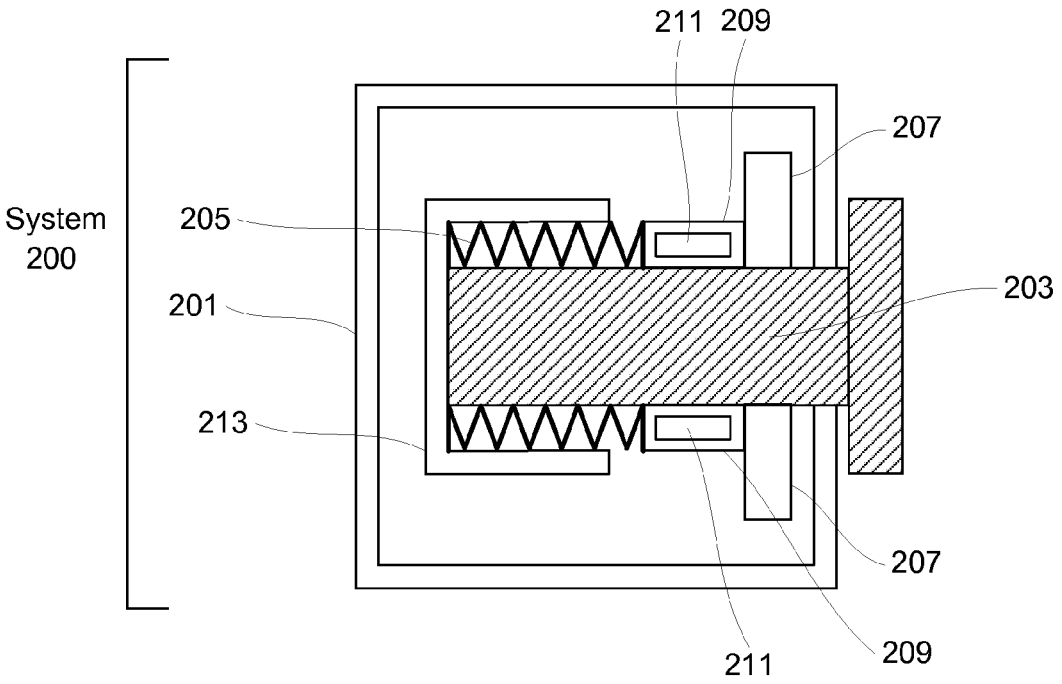
FIGS. 2A-2B are diagrammatic representations of an alternative positioning system using electromagnetic and spring forces for an electromechanical linear actuator, in accordance with some embodiments.
Figure 2B:
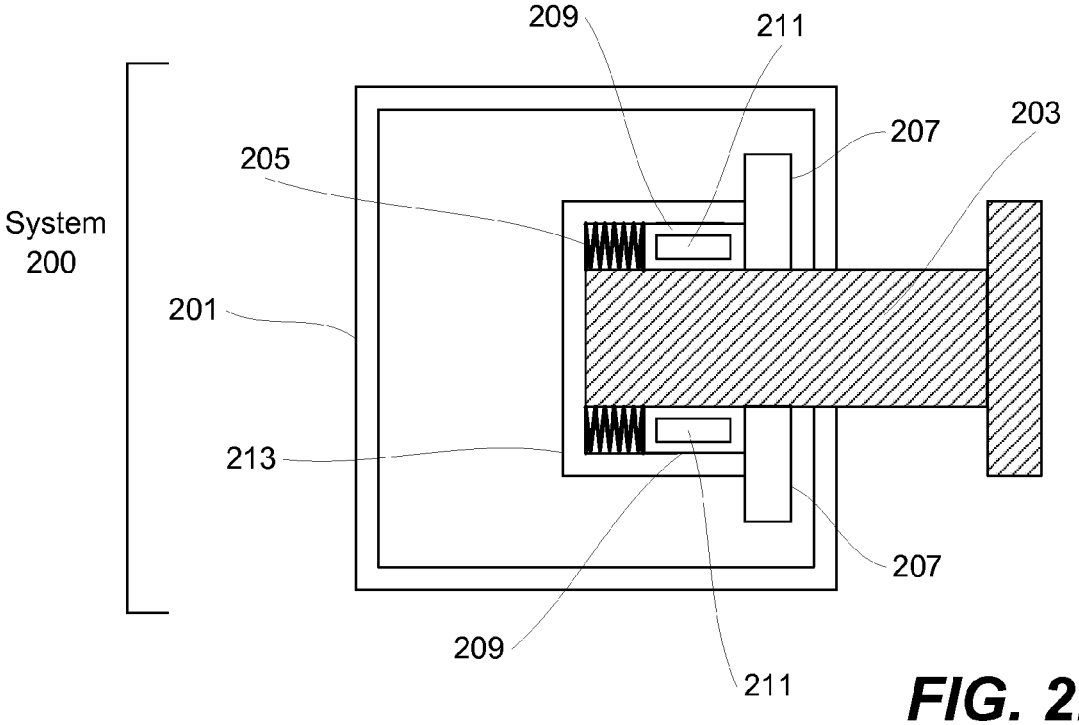

With reference to FIGS. 2A-2B, shown is an alternate embodiment of a positioning system for an electromechanical linear actuator. In particular, FIG. 2A depicts the positioning system in a refracted position and FIG. 2B depicts the positioning system in a protracted position. The shaft positioning system 200 combines the use of electromagnetic and mechanical spring forces to operate a shaft 203 that can be used to move an electromechanical actuator (not shown) to a predetermined position, such as a neutral or centered position. Application of the shaft positioning system is described in more detail with regard to FIGS. 4A-4B and 8.

In the present embodiment, positioning system 200 includes a housing 201, shaft 203, spring 205, magnet 207, metal housing 209, electromagnetic coil 211, and spring housing 213. Spring 205 can be any type of mechanical spring, such as a set of Belleville washers, bellows springs, etc. As shown in FIG. 2A, spring 205 keeps shaft 203 in a retracted position. Specifically, the spring is allowed to fully extend and keep spring housing 213 away from magnet 207. When an electrical current is applied to electromagnetic coil 211 in one direction, spring housing 213 is attracted to magnet 207 due to the magnetic forces induced by the current.

As shown in FIG. 2B, spring housing 213 then attaches itself to magnet 207, and shaft 203 is pushed into a protracted position and held in place by the attractive force between spring housing 213 and magnet 207. Once spring housing 213 is attached to magnet 207, the electrical current can be turned off. Shaft 203 then remains in this protracted position due to the attractive force between the magnet and the spring housing without any electrical current applied.

According to various embodiments, positioning system 200 can be reset to a retracted position once a protracted position is no longer needed. Specifically, to return the shaft to a retracted position, an electrical current can be pulsed through the electromagnetic coil 211 in the opposite direction from when the electrical current was applied to attract magnet 207 to spring housing 213. By pulsing the electrical current through electromagnetic coil 211 in this manner, spring housing 213 can detach from magnet 207 and begin to repel magnet 207. Once spring 205 is allowed to expand, thereby keeping spring housing 213 away from magnet 207, no more electrical current needs to be applied to the electromagnetic coil 211. In the present embodiment, if a power failure, normal power shutdown, or mechanical failure occurs, a secondary power source would be needed to return shaft 203 to a protracted position.

Figure 3A:
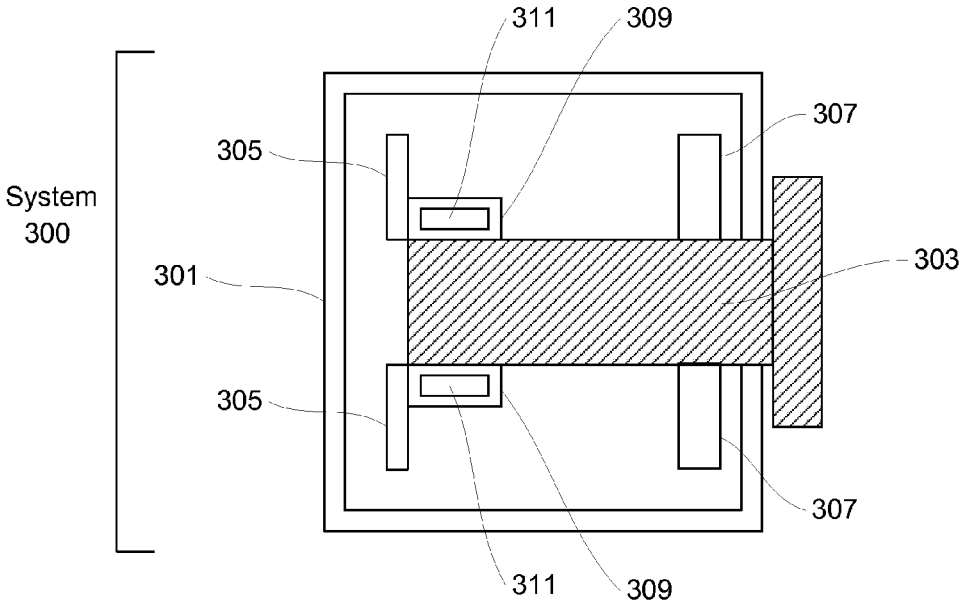
FIGS. 3A-3B are diagrammatic representations of a positioning system using electromagnetic and magnetic forces for an electromechanical linear actuator, in accordance with some embodiments.
Figure 3B:
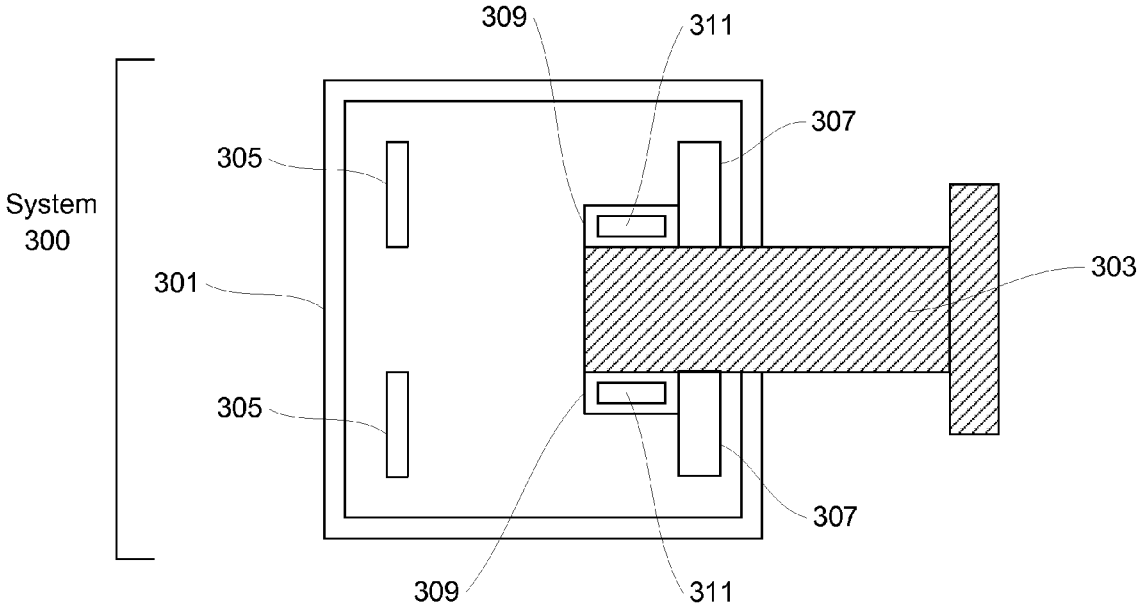

With reference to FIGS. 3A-3B, shown is another embodiment of a positioning system for an electromechanical linear actuator. In particular, FIG. 3A depicts the positioning system in a retracted position and FIG. 3B depicts the positioning system in a protracted position. The shaft positioning system 300 combines the use of electromagnetic and magnetic forces to operate a shaft 303 that can be used to move an electromechanical actuator (not shown) to a predetermined position, such as a neutral or centered position. Application of the shaft positioning system is described in more detail with regard to FIGS. 4A-4B and 8.

In the present embodiment, positioning system 300 includes a housing 301, shaft 303, weak magnet 305, strong magnet 307, metal housing 309, and electromagnetic coil 311. As shown in FIGS. 3A-3B, positioning system 300 uses two sets of magnets to move shaft 303 between a retracted and a protracted position. In order to keep shaft 303 in the retracted position depicted in FIG. 3A, electrical current must continuously flow through electromagnetic coil 311 to attract it to weak magnet 305 and repel it from strong magnet 307. Although electrical current must be continuously applied to electromagnetic coil 311 to keep shaft 303 in this position, metal housing 309 attaches to weak magnet 305 such that the shaft 303 is stabilized in this position and is limited to little or negligible movement.

In order to move shaft 303 to the protracted position, the electrical current must be reversed momentarily through electromagnetic coil 311 so that metal housing 309 will disconnect from weak magnet 305. Once the metal housing 309 is disconnected from weak magnet 305, it will attract to strong magnet 307 because strong magnet 307 will have a stronger magnetic pull on metal housing 309. Once metal housing 309 has attached to strong magnet 307, the electrical current can then be turned off because strong magnet 307 will keep shaft 303 in place.

In the event of a power failure, mechanical failure, or normal shut down, electromagnetic coil 311 will no longer be magnetized and the metal housing 309 will be attracted to the stronger of the weak magnet 305 and strong magnet 307 automatically. Once the metal housing 309 attaches to strong magnet 307, shaft 303 is secured in a protracted position. This protracted position can be used to position and secure an electromechanical actuator in some examples. Application of the shaft positioning system is described in more detail with regard to FIGS. 4A-4B and 8.

In the present embodiment, positioning system 300 can be reset to a retracted position once a protracted position is no longer needed. In particular, electrical current can be provided to electromagnetic coil 111 such that it repels strong magnet 307. Attraction between metal housing 309 and strong magnet 307 can be broken and electromagnetic coil 311 can again repel strong magnet 307, such as to cause shaft 303 to move towards weak magnet 305. Once metal housing 309 reaches weak magnet 305, it attaches to weak magnet 305 and stays in place while the electrical current is applied. In this manner, the position of shaft 303 can be controlled and reset automatically depending on the amount and direction of electrical current supplied to the electromagnetic coil 311.

Figure 4A:
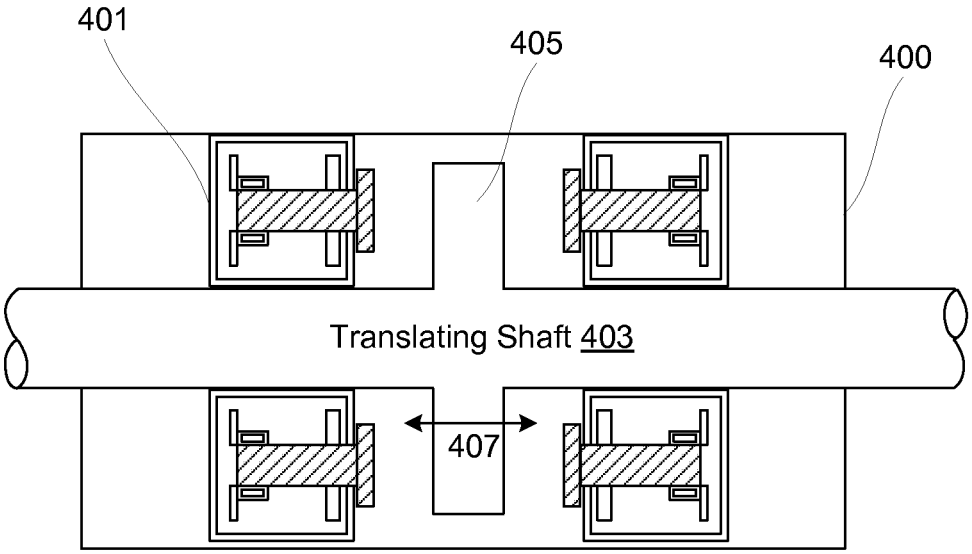
FIGS. 4A-4B are diagrammatic representations of a positioning system used with an electromechanical linear actuator, in accordance with some embodiments.
Figure 4B:
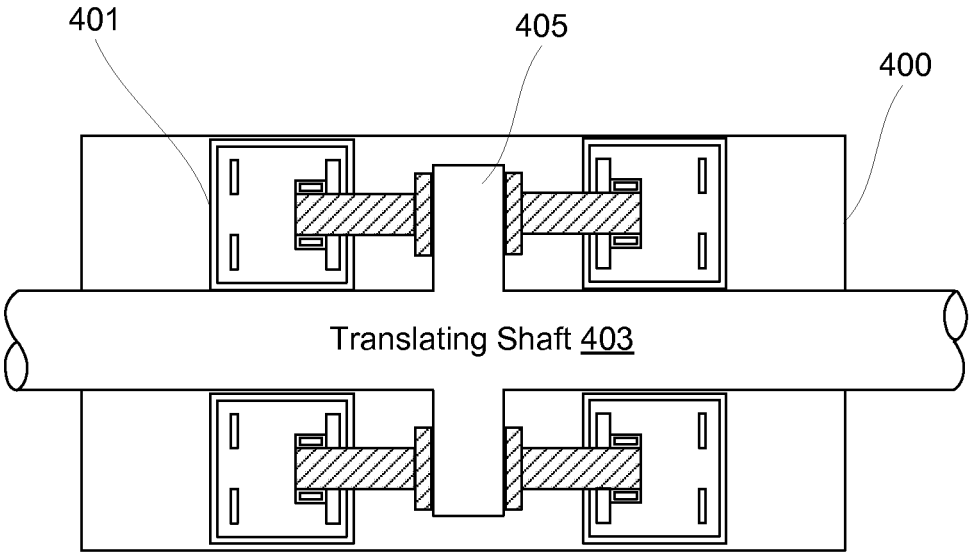

With reference to FIGS. 4A-4B, shown are diagrammatic representations of positioning systems used with an electromechanical linear actuator, in accordance with some embodiments. As shown, four positioning systems 401 are located within housing 400. Translating shaft 403 passes through housing 400 and includes flange 405. Flange 405 can project out from two sides of translating shaft 403 in some examples as shown, and can form a ring or other shape around translating shaft in other examples. Translating shaft 403 can reciprocate or translate 407 in the direction of its longitudinal axis between the retracted shafts of the positioning systems 401. This translating shaft 403 can be a part of another mechanical system or actuator that provides control of translation 407 during normal operation. Depending on the application, translation can be in the range of about ½ inch in some examples, in the range of 5 to 10 inches in other examples, or any other distance depending on how the translating shaft 403 is used within a mechanical device or actuator.

In the present embodiment, positioning systems 401 serve as a secondary fail-safe system when a primary system fails. In particular, motion of translating shaft 403 can be controlled by an actuator (not shown) that is part of the primary system. During normal actuator operation, the positioning system shafts are held in a retract position, as shown. Examples of positioning systems that can be held in retracted and protracted positions are described above with regard to FIGS. 1A-1B, 2A-2B, and 3A-3B. In the present embodiment, positioning systems like the ones described in conjunction with FIGS. 3A-3B are shown. However, any of the positioning systems previously described can be used to secure translating shaft 403 in a similar manner.

With the shafts of positioning systems 401 retracted, the translating shaft 403 is free to move through a normal stroke without interference from the positioning system shafts. However, during a power failure, mechanical failure, or normal shutdown, the positioning system shafts move into a protracted position and push up against the translating shaft flange 405. In some examples, the positioning system shafts drive the translating shaft 403 to a predetermined position, such as a center or neutral position, and hold this position, as shown in FIG. 4B.

Once the system has completed its task of stabilizing translating shaft 403, and this configuration is no longer needed, the positioning systems 401 can be returned to a refracted position, as described in more detail above with regard to FIGS. 1A-1B, 2A-2B, and 3A-3B. The positioning system shafts can be restored to their original positions, and positioning systems 401 can be used again alongside the primary actuator as a fail-safe system during future operations. As described above, the positioning systems 401 can be activated during a failure of a primary actuator or system. However, in some examples, the positioning systems can be used at other times, such as during flight, to secure an actuator shaft in a predetermined position. As explained above, the positioning systems 401 can be moved between retracted and protracted positions automatically by providing electrical current to the systems.

In the example shown in FIG. 4B, translating shaft is 403 held in a center position as its predetermined position. The positioning system shafts restrict the movement of the actuator and returns translating shaft 403 to a predetermined position. In some embodiments, the positioning system shafts can be positioned beforehand to control where the translating shaft 403 will end up when the positioning system shafts are in protracted positions. In other examples, the lengths of the positioning system shafts can be adjusted to accommodate a particular predetermined position. In some examples, the predetermined position can be a neutral position that achieves the optimal aerodynamic system, such as to reduce drag forces, etc. In other examples, a different predetermined location may be desirable. In some examples, the number of positioning system shafts may vary as appropriate to position the translating shaft 403, e.g. one, two, three, four or more positioning system shafts on each side of the translating shaft 403, or an unequal number of positioning system shafts on each side of translating shaft 403.

Figure 5A:
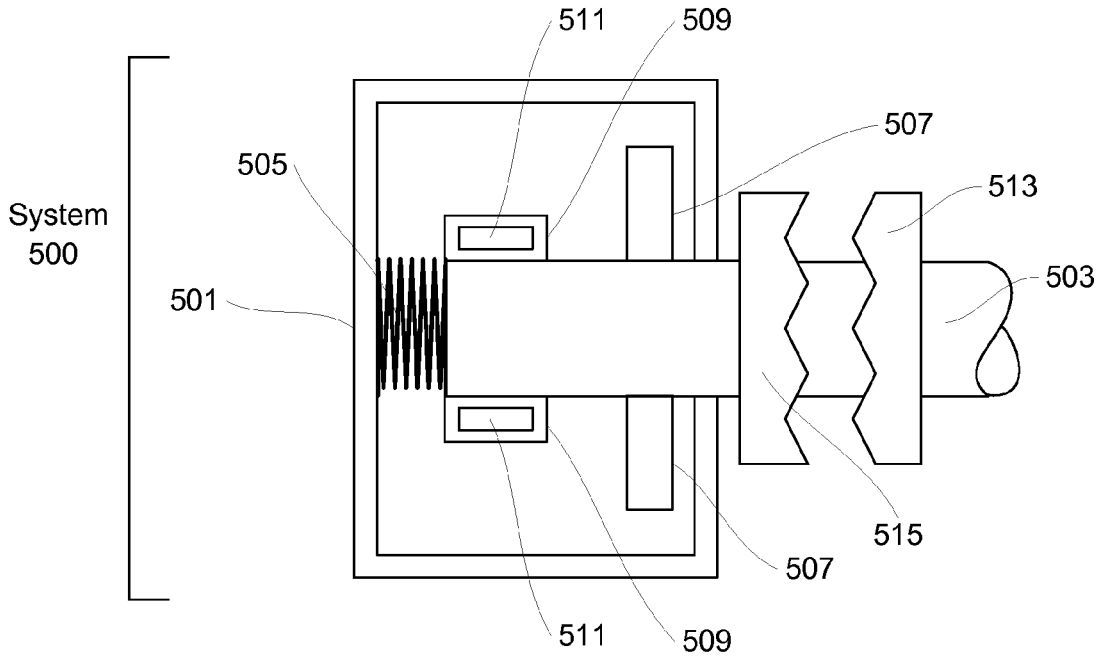
FIGS. 5A-5B are diagrammatic representations of a positioning system using electromagnetic and spring forces for an electromechanical rotary actuator, in accordance with some embodiments.
Figure 5B:
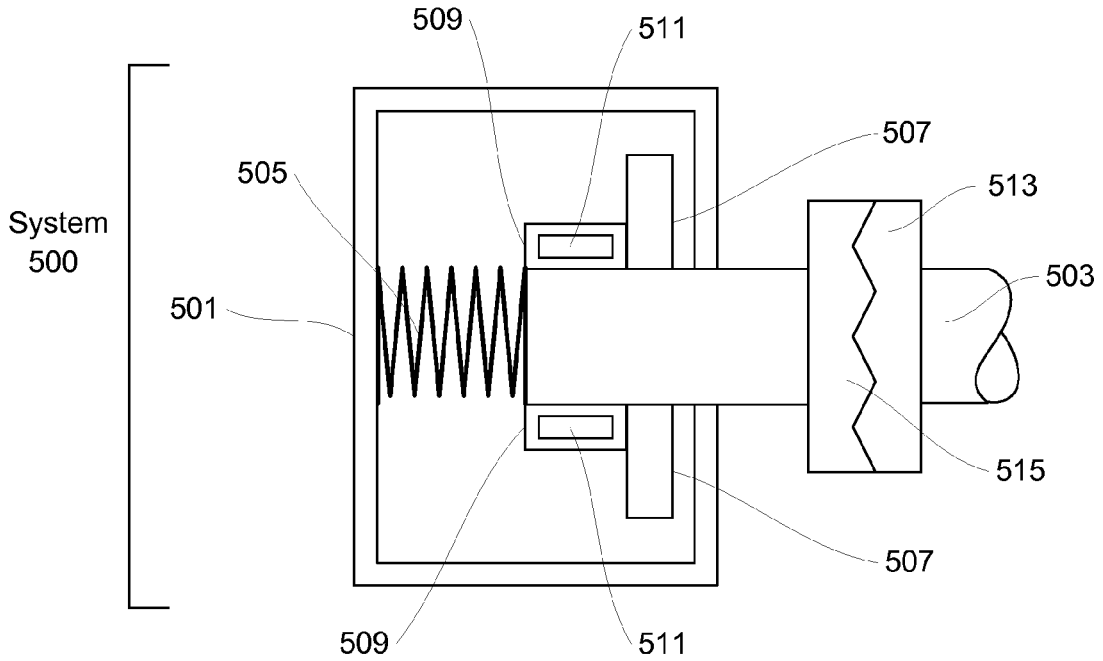

With reference to FIGS. 5A-5B, shown are diagrammatic representations of a shaft positioning system for an electromechanical rotary actuator, in accordance with some embodiments. In particular, the positioning system in FIG. 5A is shown in a refracted, unlocked position and the positioning system in FIG. 5B is shown in a protracted, locked position. The shaft positioning system 500 combines the use of electromagnetic and mechanical spring forces to operate a shaft 503, locking cam 513, and drive cam 515 with respect to each other such as to move an electromechanical actuator (not shown) to a predetermined position, such as a neutral or centered position. For instance, shaft 503 may be part of an actuator or can be an extension of an actuator. In addition, shaft 503 can be threaded in various examples, and can include roller screw or ball screw movement in some examples.

In the present embodiment, positioning system 500 integrates the electrical and mechanical functions of a spring applied electric clutch and brake to generate rotational motion that will allow an electromechanical actuator to be commanded or mechanically or electrically driven to a locked predetermined position in the event of a power shutdown, mechanical failure, or system fault. In one example, the positioning system can be used in an aircraft such that once the system mechanically locks so as to resist actuator movement of an item such as a rotor blade, the aircraft can continue the flight with all flight control authority, while active control of blade twist is not available in this locked position.

In the example shown in FIG. 5A, positioning system 500 includes housing 501, shaft 503, spring 505, magnet 507, metal housing 509, electromagnetic coil 511, locking cam 513, and driving cam 515. Spring 505 can be any type of mechanical spring, such as a set of Belleville washers, bellows springs, etc. When an electrical current is supplied to electromagnetic coil 511, the electromagnetic field produced causes the electromagnetic coil 511 to repel magnet 507. As electromagnetic coil 511 repels magnet 507, shaft 503 retracts and compresses mechanical spring 505. In this configuration, spring 505 is counterbalanced by the operation of electromagnetic coil 511. As shown, the shaft remains in a retracted position as long as an electrical current is supplied to electromagnetic coil 511.

Upon a normal power shutdown, power failure, or mechanical failure, the spring 505 expands and pushes the shaft 503 (which can move via threads, roller screw, ball screw, etc.) and drive cam 515 into a protracted position until metal housing 509 attaches to magnet 507, as shown in FIG. 5B. When the metal housing 509 attaches to magnet 507, driving cam 515 engages with locking cam 513 and shaft 513 is then stabilized into a predetermined position by the locking mechanism and the attachment of the metal housing 509 to magnet 507.

In the present embodiment, positioning system 500 combines the use of electromagnetic and mechanical spring forces to operate shaft 503 and driving cam 515 to drive a rotary electromechanical actuator to a predetermined position. For instance, positioning system 500 can be used in case of a power failure to return the rotary electromechanical actuator of a control surface or rotor blade to a safe position, or to return a control surface or rotor blade to a known position with accuracy during flight. In addition, positioning system 500 integrates the functions of electromagnets and mechanical springs to drive an electromechanical actuator to a predetermined position and mechanically and magnetically lock shaft 503 into a particular position. When locked, shaft 503 resists movement of the rotary electromechanical actuator once it is placed into the predetermined position. Once the positioning system 500 is in the locked position, electrical power can be removed from the system.

According to various embodiments, positioning system 500 provides an ability to selectively lock and unlock movement of the shaft 503, and consequently an attached actuator, with drive cam 515. In particular, positioning system 500 can be reset to an unlocked/retracted position once a locked/protracted position is no longer needed. In particular, an electrical current can be provided to electromagnetic coil 511 such that it repels magnet 507. Attraction between metal housing 509 can be broken and the electromagnetic coil 511 can again repel magnet 507, such as to cause drive cam 515 to move away from locking cam 513 and to cause shaft 503 to compress spring 505. In this unlocked position, shaft 503 can freely rotate. In this manner, movement, positioning, and locking of shaft 503 can be controlled and reset automatically depending on the amount and direction of the electrical current supplied to the electromagnetic coil 511.

Figure 6A:
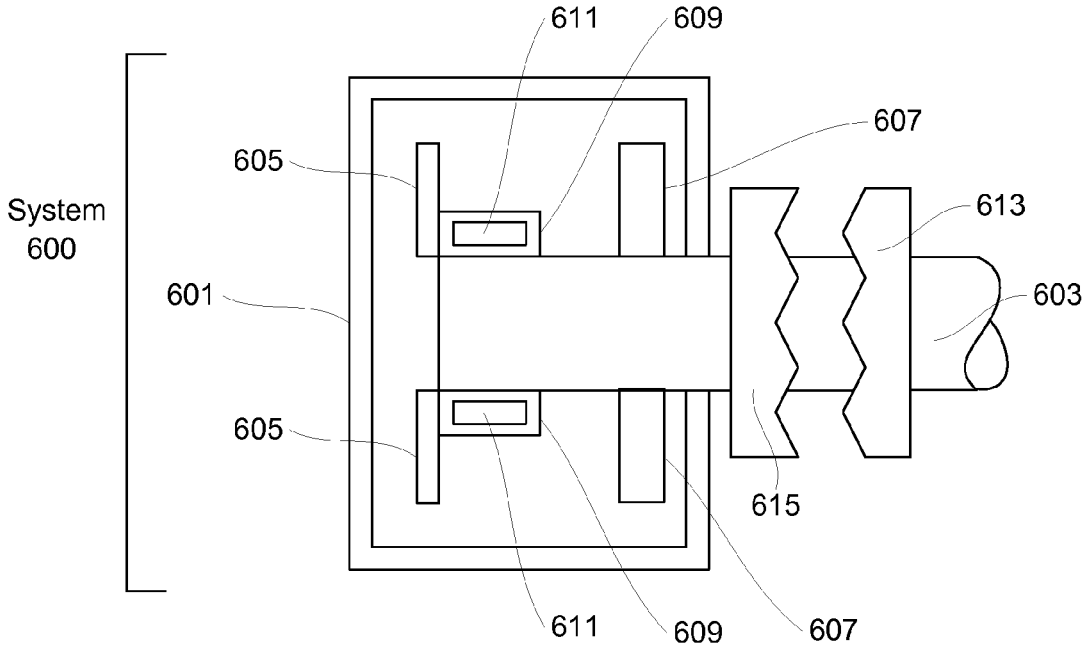
FIGS. 6A-6B are diagrammatic representations of a positioning system using electromagnetic and magnetic forces for an electromechanical rotary actuator, in accordance with some embodiments.
Figure 6B:
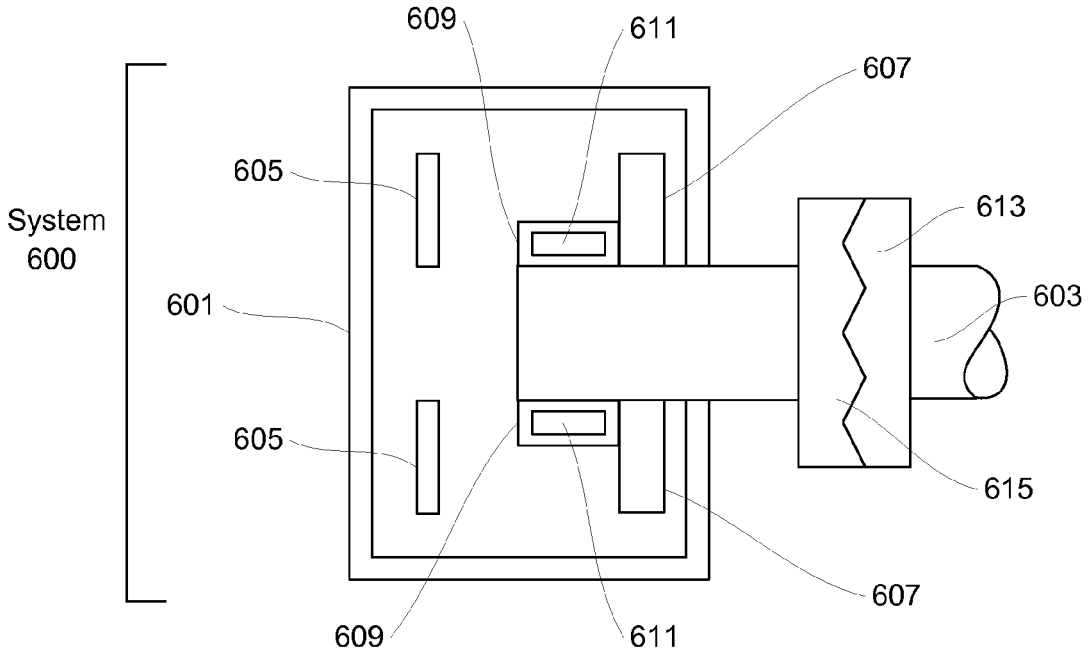

With reference to FIGS. 6A-6B, shown are diagrammatic representations of a shaft positioning system for an electromechanical rotary actuator, in accordance with some embodiments. In particular, the positioning system in FIG. 6A is shown in a refracted, unlocked position and the positioning system in FIG. 6B is shown in a protracted, locked position. The shaft positioning system 600 combines the use of electromagnetic and magnetic forces to operate a shaft 603, locking cam 613, and drive cam 615 with respect to each other such as to move an electromechanical actuator (not shown) to a predetermined position, such as a neutral or centered position. For instance, shaft 603 may be part of an actuator or can be an extension of an actuator. In addition, shaft 603 can be threaded in various examples, and can include roller screw or ball screw movement in some examples.

In the present embodiment, positioning system 600 integrates the electrical and mechanical functions of a spring applied electric clutch and brake to generate rotational motion that will allow an electromechanical actuator to be commanded or mechanically or electrically driven to a locked predetermined position in the event of a power shutdown, mechanical failure, or system fault. In one example, the positioning system can be used in an aircraft such that once the system mechanically locks so as to resist actuator movement of an item such as a rotor blade, the aircraft can continue the flight with all flight control authority, while active control of blade twist is not available in this locked position.

In the example shown in FIG. 6A, positioning system 600 includes a housing 601, shaft 603, weak magnet 605, strong magnet 607, metal housing 609, electromagnetic coil 611, locking cam 613, and driving cam 615. As shown in FIGS. 6A-6B, positioning system 600 uses two sets of magnets to move shaft 603 between an unlocked/retracted and a locked/protracted position. In order to keep shaft 603 in the retracted position depicted in FIG. 6A, electrical current must continuously flow through electromagnetic coil 611 to attract it to weak magnet 605 and repel it from strong magnet 607. Although electrical current must be continuously applied to electromagnetic coil 611 to keep shaft 603 in this position, metal housing 609 attaches to weak magnet 605 such that the shaft 603 and driving cam 615 are stabilized in this position. In some embodiments, when the shaft 603 is in this position, the actuator attached to the positioning system 600 has free rotation and can move without interference from the positioning system 600.

In order to move shaft 603 and drive cam 515 to a protracted position, the electrical current must be reversed momentarily through electromagnetic coil 611 so that metal housing 609 will disconnect from weak magnet 605. Once the metal housing 609 is disconnected from weak magnet 605, it will attract to strong magnet 607 because strong magnet 607 will have a stronger magnetic pull on metal housing 609. Once metal housing 609 has attached to strong magnet 607, the electrical current can then be turned off because strong magnet 607 will keep shaft 603 in place.

In the event of a power failure, mechanical failure, or normal shut down, electromagnetic coil 611 will no longer be magnetized and the metal housing 609 will be attracted to the stronger of the weak magnet 605 and strong magnet 607 automatically. Once the metal housing 609 attaches to strong magnet 607, shaft 603 is secured in a protracted position with metal housing 609 attached to magnet 607, as shown in FIG. 6B. When the metal housing attaches to magnet 607, driving cam 615 engages with locking cam 613 and shaft 603 is then stabilized into a predetermined position by the locking mechanism and the attachment of the metal housing 609 to magnet 607.

In the present embodiment, positioning system 600 combines the use of electromagnetic and magnetic forces to operate shaft 603 and driving cam 615 to drive a rotary electromechanical actuator to a predetermined position. For instance, positioning system 600 can be used in case of a power failure to return a rotary electromechanical actuator of a control surface or rotor blade to a safe position, or to return a control surface or rotor blade to a known position with accuracy during flight. In addition, positioning system 600 integrates the functions of electromagnets and magnets to drive an electromechanical actuator to a predetermined position and mechanically and magnetically lock shaft 603 into a particular position. When locked, shaft 603 resists movement of the rotary electromechanical actuator once it is placed into the predetermined position. Once the positioning system 600 is in the locked position, electrical power can be removed from the system.

According to various embodiments, positioning system 600 provides an ability to selectively lock and unlock movement of the shaft 603, and consequently an attached actuator, with drive cam 615. In particular, positioning system 600 can be reset to an unlocked/retracted position once a locked/protracted position is no longer needed. In particular, electrical current can be provided to electromagnetic coil 611 such that it repels strong magnet 607. Attraction between metal housing 609 and strong magnet 607 can be broken and electromagnetic coil 611 can again repel strong magnet 607, such as to cause shaft 603 to move towards weak magnet 605. Once metal housing 609 reaches weak magnet 605, it attaches to weak magnet 605 and stays in place while the electrical current is applied. In this manner, the position of shaft 603 and drive cam 615 can be controlled and reset automatically depending on the amount and direction of electrical current supplied to the electromagnetic coil 611.

Figure 7A:
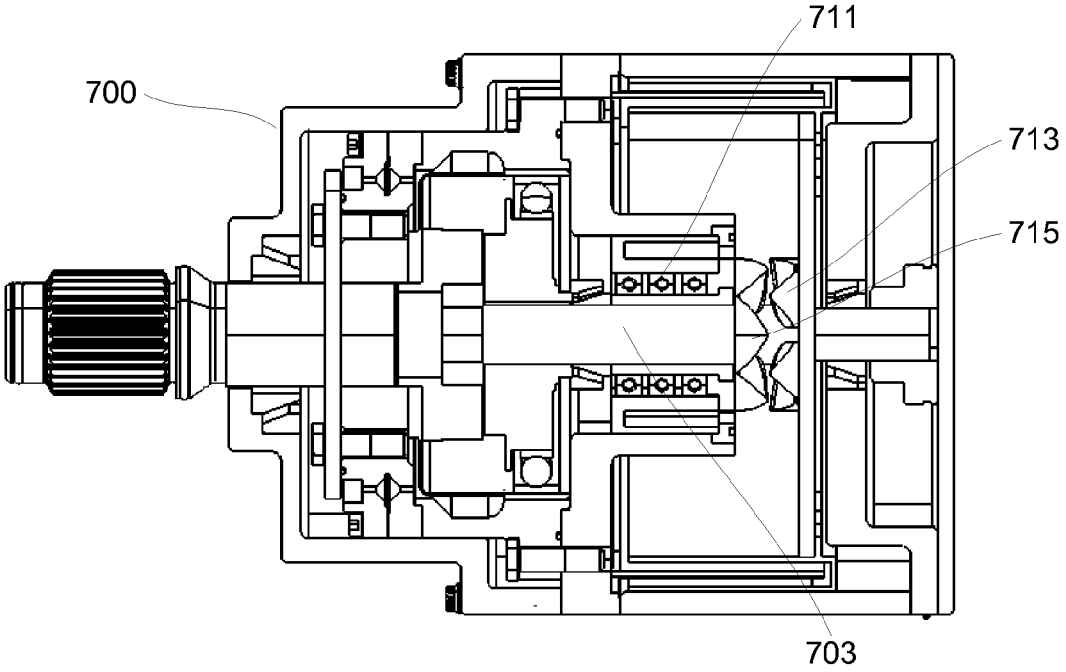
FIGS. 7A-7B are diagrammatic representations of a positioning system used with an electromechanical rotary actuator, in accordance with some embodiments.
Figure 7B:
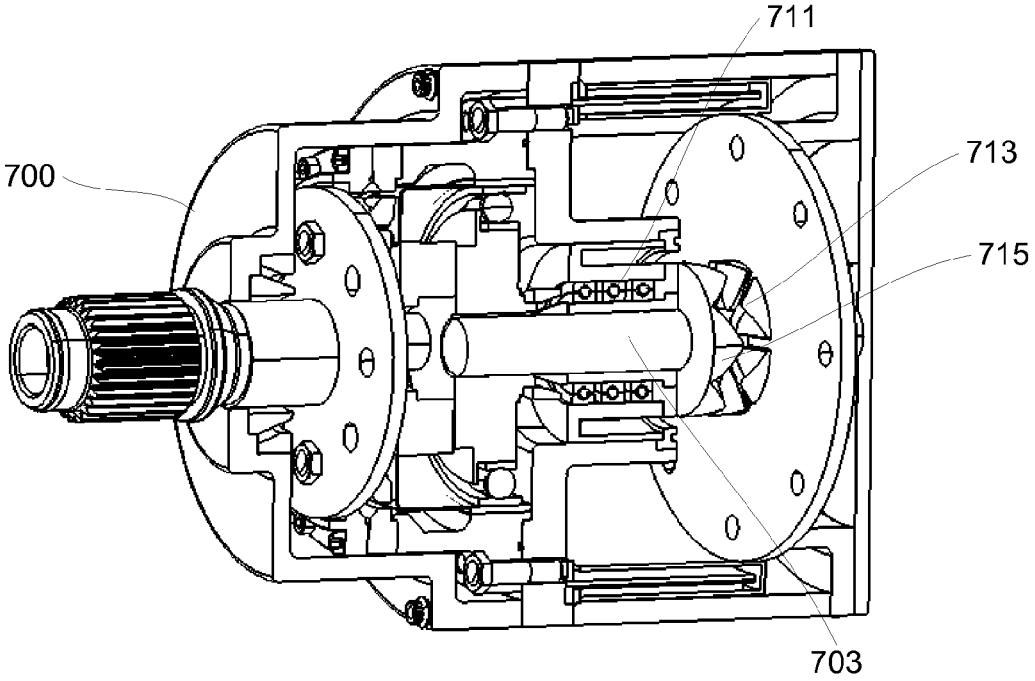

With reference to FIGS. 7A-7B, shown is one example of a positioning system used with an electromechanical rotary actuator. In the present embodiment, electromechanical rotary actuator 700 is shown with a positioning system installed. The positioning system includes shaft 703, electromagnetic coil 711, locking cam 713, and drive cam 715. Translating shaft 703 can translate freely along its longitudinal axis during normal operation. Depending on the application, translation can be in the range of about ½ inch in some examples, in the range of 5 to 10 inches in other examples, or any other distance depending on how the translating shaft 703 is used.

In the present embodiment, the positioning system serves as a secondary fail-safe system when a primary system fails. In particular, motion of translating shaft 703 can be controlled by the actuator, which is part of the primary system. During normal actuator operation, the positioning system shafts are held in an unlocked, retract position, as shown. Examples of positioning systems that can be held in unlocked/retracted and locked/protracted positions are described above with regard to FIGS. 5A-5B and 6A-6B. As shown, locking cam 713 and drive cam 715 are not engaged during the unlocked/retracted position. However, during a power failure, mechanical failure, or normal shutdown, the positioning system moves into a protracted position and locking cam 713 and drive cam 715 engage to lock rotational and axial movement of shaft 703. In some examples, the positioning system drives the translating shaft 703 to a predetermined position, such as a center or neutral position.

Once the system has completed its task of stabilizing translating shaft 703, and this configuration is no longer needed, the positioning system can be returned to an unlocked/retracted position, as described in more detail above with regard to FIGS. 5A-5B and 6A-6B. The positioning system shaft can be restored to its original position, and the primary actuator can resume free movement. As described above, the positioning system can be activated during a failure of a primary actuator or system. However, in some examples, the positioning system can be used at other times, such as during flight, to secure an actuator shaft in a predetermined position. In some examples, the predetermined position can be a neutral position that achieves the optimal aerodynamic system, such as to reduce drag forces, etc. In other examples, a different predetermined location may be desirable. As explained above, the positioning system can be moved between unlocked/retracted and locked/protracted positions automatically by providing electrical current to the systems.

Operating Examples

Figure 8:
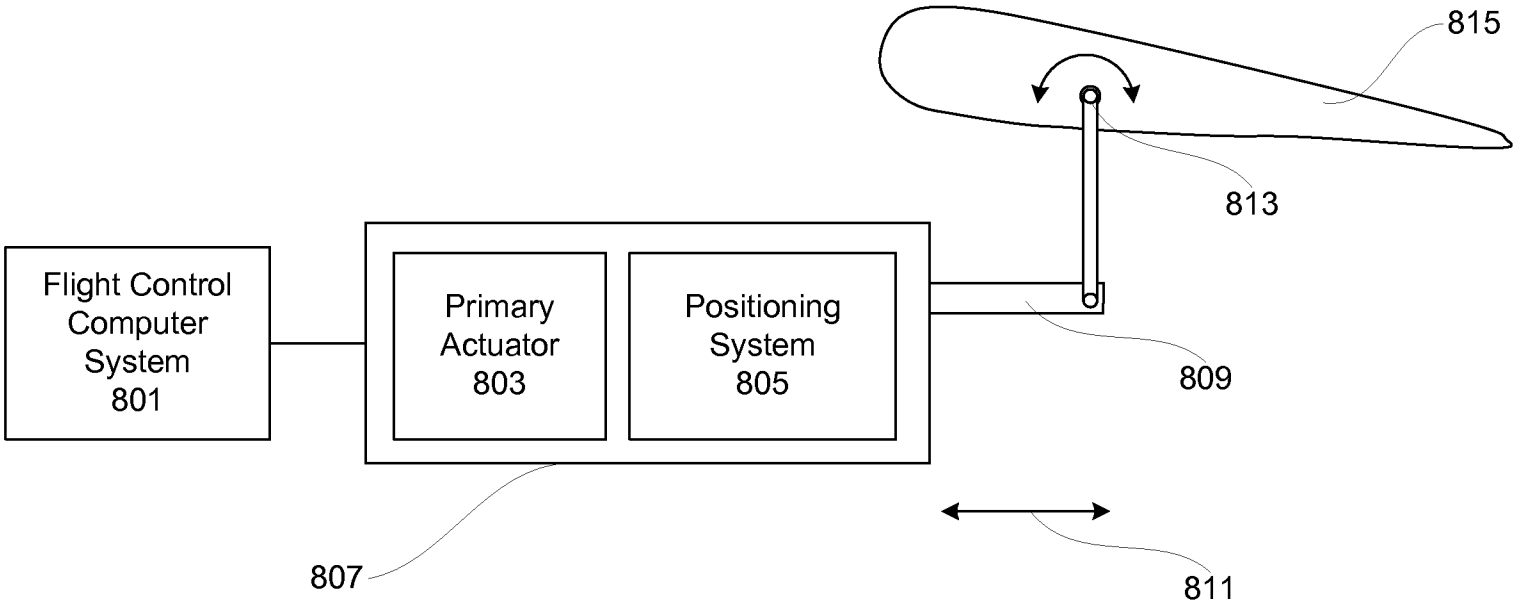
FIG. 8 is a diagrammatic representation of an aircraft flight control system, in accordance with some embodiments.

According to various embodiments, a positioning system (examples of which are described more fully above) can be used as a secondary fail-safe system when a primary system fails. In particular, such a positioning system can be used to address the challenge of returning electromechanical actuators to a known or neutral position in the event of a power failure, the shutdown of electric power, or a mechanical failure. With reference to FIG. 8, shown is a diagrammatic representation of an aircraft flight control system, in accordance with some embodiments. In particular embodiments, a positioning system can be used in aircraft control systems. Specifically, a positioning system can be used as a secondary fail-safe system when a primary actuator fails.

Aircraft (not shown for clarity, but well known in the art) are well-known to have wings that are attached to a fuselage. Control surfaces in the wings control the rate of climb and descent, among other things. The tail section attached to the rear of the fuselage provides steering and maneuverability. An engine provides thrust and can be attached to the plane at the wings, in the tail, or to the fuselage. Inasmuch as aircraft structures are well-known, their illustration is omitted here for simplicity. Various actuators control the movement of flight control surfaces in the wings, tail, landing gear, landing gear bay doors, engine thrust reversers, and the like.

In the present embodiment, one example of a control surface 815 is shown. In this example, translating shaft 809 is coupled to a pivot point 813 of a control surface 815 of an aircraft. Movement of the translating shaft 809 in the direction indicated by the arrows 811 is but one way that primary actuator 803 can cause a control surface, e.g., spoilers, flaps, elevators, rudder or ailerons, to move and thereby control the aircraft. Similar translation can control other flight control surfaces, fuselage doors, landing gear, thrust reverses, and the like.

According to the present embodiment, a flight control computer system 801 is electrically coupled to primary actuator 803 and positioning system 805, both of which are located in housing 807. In some examples, primary actuator 803 can be an electrically powered linear actuator. In other examples, primary actuator 803 can be an electromechanical rotary actuator. During normal operations, primary actuator 803 controls the movements of translating shaft 809. Positioning system 805 is typically activated during a failure of primary actuator 803. Accordingly, positioning system 805 does not interfere with primary actuator 803 or the movement of translating shaft 809 during normal operations. In addition, primary actuator 803 may operate for many repeated uses without positioning system 805 being triggered or activated. In addition, using a positioning system to control electromechanical actuators during such events as a power failure, mechanical failure, or normal shutdown, allows flight control computer 801 to know the position of the electromechanical actuator at all times, such that the flight performance of an aircraft can be predicted, in various examples.

Examples of Aircraft

Figure 9A:
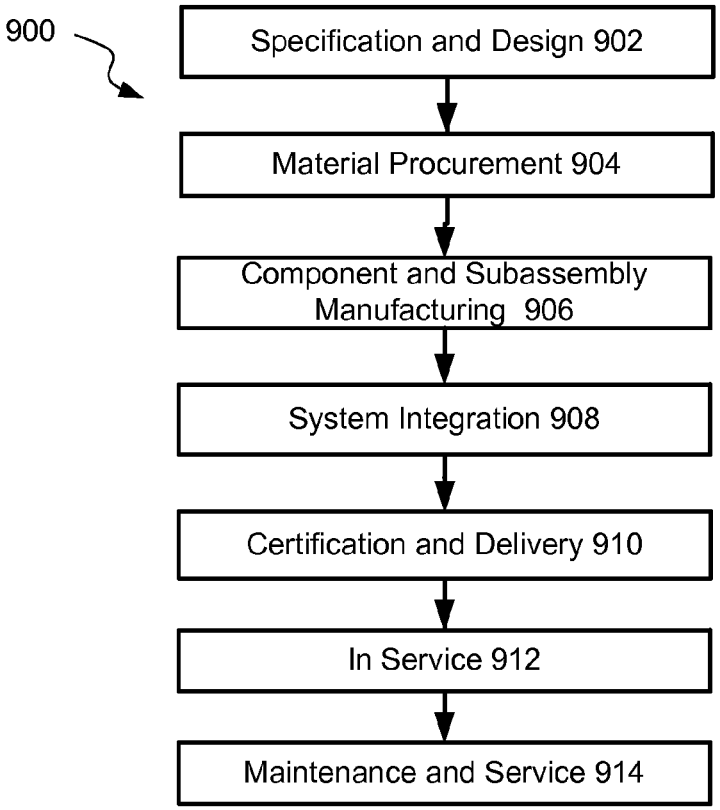
FIG. 9A is a process flowchart reflecting key operations in the life cycle of an aircraft from early stages of manufacturing to entering service, in accordance with some embodiments.

An aircraft manufacturing and service method 900 shown in FIG. 9A and an aircraft 930 shown in FIG. 9B will now be described to better illustrate various features of processes and systems presented herein. During pre-production, aircraft manufacturing and service method 900 may include specification and design 902 of aircraft 930 and material procurement 904. The production phase involves component and subassembly manufacturing 906 and system integration 908 of aircraft 930. Thereafter, aircraft 930 may go through certification and delivery 910 in order to be placed in service 912. While in service by a customer, aircraft 930 is scheduled for routine maintenance and service 914 (which may also include modification, reconfiguration, refurbishment, and so on). Although the embodiments described herein can be implemented during the production phase of commercial aircraft, they may be practiced at other stages of the aircraft manufacturing and service method 900.

Each of the processes of aircraft manufacturing and service method 900 may be performed or carried out by a system integrator, a third party, and/or an operator (e.g., a customer). For the purposes of this description, a system integrator may include, without limitation, any number of aircraft manufacturers and major-system subcontractors; a third party may include, for example, without limitation, any number of vendors, subcontractors, and suppliers; and an operator may be an airline, leasing company, military entity, service organization, and so on.

Figure 9B:
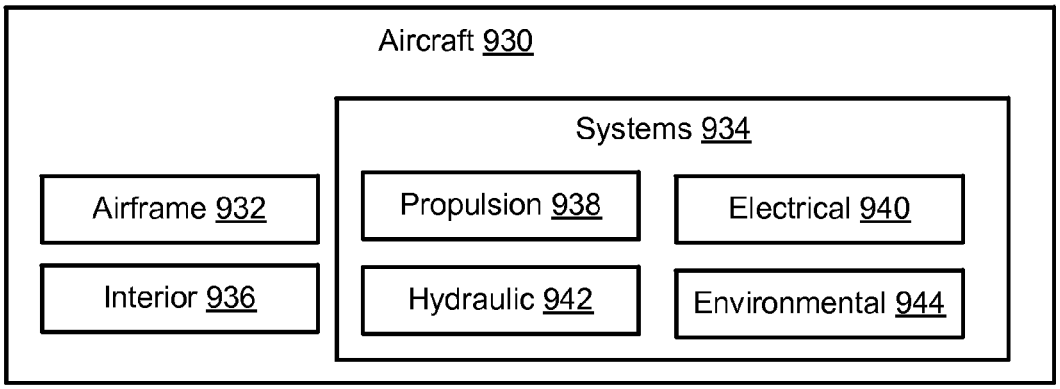
FIG. 9B is a block diagram illustrating various key components of an aircraft, in accordance with some embodiments.

As shown in FIG. 9B, aircraft 930 produced by aircraft manufacturing and service method 900 may include airframe 932, interior 936, and multiple systems 934. Examples of systems 934 include one or more of propulsion system 938, electrical system 940, hydraulic system 942, and environmental system 944. Any number of other systems may be included in this example. Although an aircraft example is shown, the principles of the disclosure may be applied to other industries, such as the automotive industry.

Apparatus and methods embodied herein may be employed during any one or more of the stages of aircraft manufacturing and service method 900. For example, without limitation, components or subassemblies corresponding to component and subassembly manufacturing 906 may be fabricated or manufactured in a manner similar to components or subassemblies produced while aircraft 930 is in service.

Also, one or more apparatus embodiments, method embodiments, or a combination thereof may be utilized during component and subassembly manufacturing 906 and system integration 908, for example, without limitation, by substantially expediting assembly of or reducing the cost of aircraft 930. Similarly, one or more of apparatus embodiments, method embodiments, or a combination thereof may be utilized while aircraft 930 is in service, for example, without limitation, maintenance and service 914 may be used during system integration 908 to determine whether parts may be connected and/or mated to each other.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A shaft positioning system comprising:

a shaft coupled to an electromechanical actuator,
  wherein the shaft moves along a linear axis,
  wherein the electromechanical actuator is free to translate during normal operation;

an electromagnetic coil positioned around at least a portion of the shaft,
  wherein the electromagnetic coil produces a magnetic field when electrical current is applied;

a metal housing surrounding at least a portion of the electromagnetic coil;

a first magnet,
  wherein the shaft is placed in a predetermined position when the metal housing is in contact with the first magnet, and
  wherein translational motion of the electromechanical actuator is restricted when the shaft is placed in the predetermined position;

a driving cam coupled to the shaft; and a locking cam,
  wherein the driving cam and the locking cam engage when the driving cam is in a protracted position thereby locking the shaft in the predetermined position and preventing further rotation of the shaft relative to the metal housing while the driving cam and the locking cam remain engaged, and
  wherein the driving cam and locking cam are disengaged when the driving cam is in a retracted position.

2. The shaft positioning system of claim 1, further comprising a spring coupled to the shaft, wherein the spring holds the shaft in the retracted position when the electrical current is applied to the electromagnetic coil, and wherein the electromagnetic coil repels the first magnet when the electrical current is applied.

3. The shaft positioning system of claim 2, wherein the metal housing attracts to the first magnet when no electrical current is applied to the electromagnetic coil.

4. The shaft positioning system of claim 1, further comprising a second magnet, wherein the second magnet has a weaker magnetic field than the first magnet.

5. The shaft positioning system of claim 4, wherein the metal housing contacts the second magnet when the electrical current is applied to the electromagnetic coil.

6. The shaft positioning system of claim 4, wherein the metal housing contacts the first magnet when no electrical current is applied to the electromagnetic coil.

7. The shaft positioning system of claim 1, wherein the electromechanical actuator is a linear actuator, and wherein the shaft engages with a flange of the linear actuator when the shaft is moved into the predetermined position.

8. The shaft positioning system of claim 1, wherein the shaft is part of a rotary actuator.

9. The shaft positioning system of claim 1, wherein the shaft moves to the predetermined position during a power failure.

10. An apparatus comprising:

a flight control computer system;

a translating shaft having an axis;

an electromechanical actuator that moves the translating shaft along the axis, wherein the electromechanical actuator is communicatively coupled to the flight control computer; and a shaft positioning system comprising:

a shaft coupled to the electromechanical actuator, wherein the shaft moves along a linear axis, wherein the electromechanical actuator is free to translate during normal operation;

an electromagnetic coil positioned around at least a portion of the shaft, wherein the electromagnetic coil produces a magnetic field when electrical current is applied;

a metal housing surrounding the electromagnetic coil; and a first magnet, wherein the shaft is placed in a predetermined position when the metal housing is in contact with the first magnet, and wherein translational motion of the translating shaft and the electromechanical actuator is restricted when the shaft is placed in the predetermined position;

a driving cam coupled to the shaft; and a locking cam, wherein the driving cam and the locking cam engage when the driving cam is in a protracted position thereby locking the shaft in the predetermined position and preventing further rotation of the shaft relative to the metal housing while the driving cam and the locking cam remain engaged, and wherein the driving cam and locking cam are disengaged when the driving cam is in a retracted position.

11. The apparatus of claim 10, further comprising a spring coupled to the shaft, wherein the spring holds the shaft in the retracted position when the electrical current is applied to the electromagnetic coil, and wherein the electromagnetic coil repels the first magnet when the electrical current is applied.

12. The apparatus of claim 11, wherein the metal housing attracts to the first magnet when no electrical current is applied to the electromagnetic coil.

13. The apparatus of claim 10, further comprising a second magnet, wherein the second magnet has a weaker magnetic field than the first magnet.

14. The apparatus of claim 13, wherein the metal housing contacts the second magnet when the electrical current is applied to the electromagnetic coil.

15. The apparatus of claim 13, wherein the metal housing contacts the first magnet when no electrical current is applied to the electromagnetic coil.

16. The apparatus of claim 10, wherein the electromechanical actuator is a linear actuator, and wherein the shaft engages with a flange of the linear actuator when the shaft is moved into the predetermined position.

17. The apparatus of claim 10, wherein the shaft is part of a rotary actuator.

18. The apparatus of claim 10, wherein the shaft moves to the predetermined position during a power failure.

19. A method comprising:

driving a shaft using an electromechanical actuator, wherein the electromechanical actuator is free to translate during normal operation;

applying an electrical current to an electromagnetic coil to produce a change in magnetic field, wherein the electromagnetic coil is positioned around at least a portion of the shaft and is at least partially surrounded by a metal housing, and wherein the shaft moves in response to the change in the magnetic field; and restricting a translational motion of the electromechanical actuator when the shaft is placed in a predetermined position, wherein the shaft is placed in the predetermined position when the metal housing is in contact with a first magnet wherein a driving cam and a locking cam engage when the driving cam is in a protracted position thereby locking the shaft coupled to the driving cam in the predetermined position and preventing further rotation of the shaft relative to the metal housing while the driving cam and the locking cam remain engaged, and wherein the driving cam and locking cam are disengaged when the driving cam is in a retracted position.

20. The method of claim 19, wherein a spring holds the shaft in the retracted position when the electrical current is applied to the electromagnetic coil, and wherein the electromagnetic coil repels the first magnet when the electrical current is applied.

21. The shaft positioning system of claim 20, wherein the metal housing attracts to the first magnet when no electrical current is applied to the electromagnetic coil.

* * * * *